US009949536B2

(12) United States Patent
Norwood et al.

(10) Patent No.: US 9,949,536 B2
(45) Date of Patent: Apr. 24, 2018

(54) FASTENER SYSTEM FOR FABRICS

(71) Applicant: Good Threads, Inc., Denver, CO (US)

(72) Inventors: Amy Norwood, Denver, CO (US); Bryan Krueger, Denver, CO (US)

(73) Assignee: Good Threads, Inc., Denver, CO (US)

( * ) Notice: Subject to any disclaimer, the term of this patent is extended or adjusted under 35 U.S.C. 154(b) by 0 days.

(21) Appl. No.: 14/209,051

(22) Filed: Mar. 13, 2014

(65) Prior Publication Data

US 2014/0259540 A1 Sep. 18, 2014

Related U.S. Application Data

(60) Provisional application No. 61/790,527, filed on Mar. 15, 2013.

(51) Int. Cl.
*A44C 1/00* (2006.01)
*A44C 3/00* (2006.01)

(52) U.S. Cl.
CPC ..... *A44C 1/00* (2013.01); *A44C 3/001* (2013.01); *Y10T 24/3649* (2015.01); *Y10T 24/44017* (2015.01); *Y10T 24/44026* (2015.01)

(58) Field of Classification Search
CPC ..... A44C 1/00; A44C 3/001; Y10T 24/3649; Y10T 24/3626; Y10T 24/3651; Y10T 24/3655; Y10T 24/3685; Y10T 24/3694; Y10T 24/13; Y10T 24/1306; Y10T 24/1365; Y10T 24/1309; Y10T 24/3467; Y10T 24/3481; Y10T 24/44017; Y10T 24/44026; Y10T 24/46; Y10T 24/1938; Y10T 24/4602
USPC ..... 403/291; 40/1.5, 651, 606.14
See application file for complete search history.

(56) References Cited

U.S. PATENT DOCUMENTS 1,220,829 A * 3/1917 Elliott ..... A44B 1/44 24/94
5,062,436 A * 11/1991 Emsellem ..... A45D 8/24 132/275
2010/0186448 A1* 7/2010 Sarra ..... A45C 13/08 63/33

* cited by examiner

*Primary Examiner* — Robert Sandy
*Assistant Examiner* — Michael S Lee
(74) *Attorney, Agent, or Firm* — Polsinelli PC

(57) ABSTRACT

Implementations described and claimed herein provide systems, apparatuses, and methods for removably fastening a decoration to a garment (e.g., a scarf or hat) or other decorative material, such that the decoration is secured in a desired orientation. In one implementation, a decorative fastener includes a decoration and a receiver. The decoration has a decorative member and a pin. The decorative member has a surface displaying aesthetic content and a fastening surface. The pin has a securing portion extending from the fastening surface. The securing portion has one or more securing features. The receiver has at least one receiving feature protruding from a surface and forming a plurality of fastening paths. Each of the fastening paths is configured to receive the securing portion of the pin. An orientation of the surface of the decorative member displaying the aesthetic content is based on a selection of one of the plurality of fastening paths.

19 Claims, 12 Drawing Sheets

FASTENER SYSTEM FOR FABRICS

CROSS-REFERENCE TO RELATED APPLICATIONS

The present application claims priority under 35 U.S.C. § 119 to U.S. Provisional Application No. 61/790,527, which was filed Mar. 15, 2013 and entitled "Fastener System for Fabrics." The aforementioned application is hereby incorporated by reference in its entirety into the present application.

BACKGROUND

Many different fabrics are used as garments to decorate a person, item, or space. For example, scarves are generally used to decorate and clothe a neck, face, head, and/or shoulder regions of a person. Scarves are often an elongated textile material sized to drape, wind, or tie around one or more regions of a person. Various types of hats are further used to decorate and clothe a head region of a person.

Sometimes a pin, brooch, or other decoration is attached to a garment to enhance the decorative effect of the garment or to otherwise fasten or secure the garment in various configurations. Conventionally, such a decoration is attached to the garment using a sharp, thin pin that penetrates the textile of the garment. Such conventional pins are generally in the form of safety pins that include a sharp, thin pin with a point bendable back towards the head where it can be held with a guard when closed. However, these pins are often visible and unpleasant aesthetically. Further, these pins are easily weighed down by the decoration and make it challenging to secure the decoration in a desirable orientation.

It is with these observations in mind, among others, that various aspects of the present disclosure were conceived and developed.

SUMMARY

Implementations described and claimed herein address the foregoing problems, among others, by providing a fastener system that removably mounts a decoration to a garment or other decorative material such that the decoration is secured in a desired orientation. In one implementation, a decorative fastener includes a decoration and a receiver. The decoration has a decorative member and a pin. The decorative member has a surface displaying aesthetic content and a fastening surface. The pin has a securing portion extending from the fastening surface. The securing portion has one or more securing features. The receiver has at least one receiving feature protruding from a surface and forming a plurality of fastening paths. Each of the fastening paths is configured to receive the securing portion of the pin. An orientation of the surface of the decorative member displaying the aesthetic content is based on a selection of one of the plurality of fastening paths.

Other implementations are also described and recited herein. Further, while multiple implementations are disclosed, still other implementations of the presently disclosed technology will become apparent to those skilled in the art from the following detailed description, which shows and describes illustrative implementations of the presently disclosed technology. As will be realized, the presently disclosed technology is capable of modifications in various aspects, all without departing from the spirit and scope of the presently disclosed technology. Accordingly, the drawings and detailed description are to be regarded as illustrative in nature and not limiting.

DETAILED DESCRIPTION

Figure 1B:
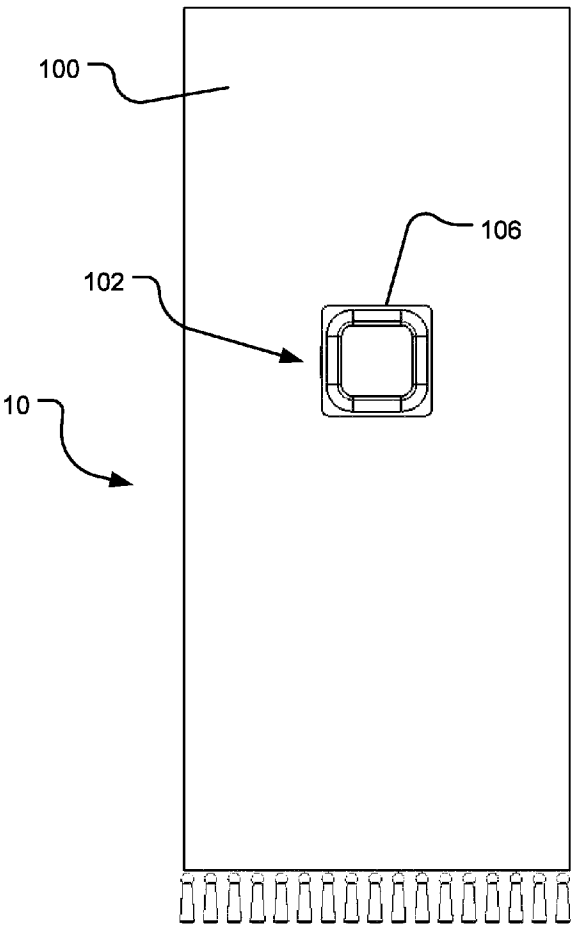
FIGS. 1A and 1B are front and back schematic views, respectively, of an example decorative fastener secured to a garment.

Aspects of the present disclosure involve systems, apparatuses, and methods for securing a decorative fastener to a fabric or other a decorative material. In the case of a garment, such as a scarf, people use many different approaches for draping or otherwise tying the scarf around their shoulders and neck. For example, one person may cross the two ends of the scarf in front of his or her neck to form an opening and loop one end through the opening, while another person may fold the scarf in half prior to wrapping it around his or her neck to form an opening through which the unfolded end is inserted. Infinity scarves, which are circular scarves with no ends and a tubular configuration formed by coupling material together to form an interior region, similarly involve various approaches for draping or otherwise tying around the neck and shoulders.

The decorative fastener, which may display a pin, brooch, or other decoration, is attached to the scarf to enhance the decorative effect of the scarf or to otherwise fasten or secure the scarf in various configurations. Various features of the decorative fastener ensure the decoration is oriented upright independent of a chosen approach for draping the scarf, among other advantages. Stated differently, regardless of what method a person chooses for draping a scarf, the systems, apparatuses, and methods of the present disclosure orient the decoration upright once fastened to the scarf.

In one particular aspect, the scarf includes one or more groups of openings (e.g., eyelets) positioned at different locations on the scarf. Each of the groups of openings includes a plurality of openings oriented relative to one another. For example, each of the groups of openings may include four openings oriented at 90° angles relative to each other. Based on the orientation of the scarf once it is draped over the person, the person may select one of the openings to insert the decoration to orient it upright. The decoration includes a decorative member, which may be a brooch, jewelry, pin, or other aesthetic content, and a pin that is mounted to the decorative member. A receiver is fixed to a hidden surface of the scarf to receive and engage the pin. The receiver includes a receiving plate that has a plurality of receiving features protruding from a surface. The receiving features may be, for example, triangular shaped protrusions with one corner of each of the receiving features pointing towards an opposite receiving feature. The receiving features are symmetrically oriented with respect to each other on the surface, thereby forming different fastening paths. For example, the fastening paths may be positioned along the 90° angles adjacent to the openings in the scarf, providing four orientation options for fastening the decoration.

A person may own different decorations for various occasions, such as sporting events (e.g., displaying a team logo), affiliation or community events (e.g., displaying a motorcycle company logo), or formal events (e.g., displaying jewelry or other formal aesthetic content). The presently disclosed technology enables the exchange of one decoration for another depending on the event and preferences of the person. While the above example discussed a scarf, among other features, it will be appreciated by those skilled in the art that the example was intended to be illustrative in nature and not limiting.

Figure 1A:
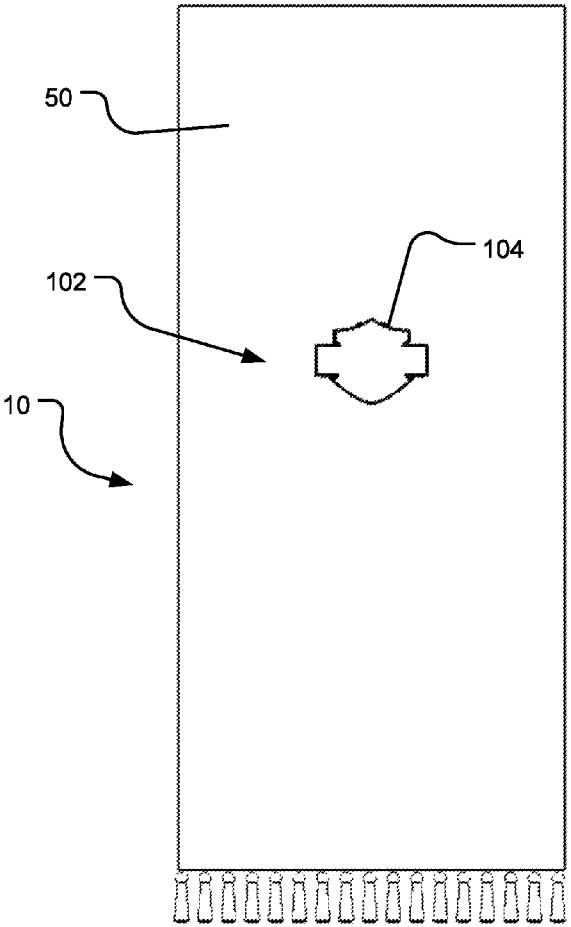

For a detailed description of an example decorative fastener 102 secured to a decorative material 10, reference is made to FIGS. 1A and 1B, which are front and back schematic views, respectively. In one implementation, the decorative material 10 is a strip or wed of textile material having a decorative surface 50 and a hidden surface 100. In another implementation, the decorative material 10 includes a plurality of layers, forming one or more inner surfaces. In still another implementation, the decorative material 10 is a tubular configuration formed by the decorative surface 50 coupling to the hidden surface 100 to form an interior region (not shown). However, other configurations and surfaces are contemplated. The decorative material 10 may be, without limitation, a garment, including, without limitation, scarves, hats, shawls, jerseys, coats, sweaters, shirts, pants, or other clothing items. Further, it will be appreciated that the decorative material 10 may include bags, furniture, or other fabrics or decorative textile materials.

In one implementation, the decorative surface 50 of the decorative material 10 displays a decoration 104 of the decorative fastener 102. In one implementation, the decoration 104 extends through the decorative material 10 from the decorative surface 50 to the hidden surface 100 where the decoration 104 engages a fastener 106. In another implementation, the decoration 104 is held against the decorative surface 50 by the fastener 106, for example, using one or more magnets or the like. The fastener 106 is fixed to the hidden surface 100 and is configured to removably fasten the decoration 102 to the decorative surface 50 in an upright position, independent of the orientation of the decorative material 10.

The decorative fastener 102 may be made from various materials, including, but not limited to, metal, plastic, ceramic, wood, other robust materials, and some combination of them. In one implementation, the decorative fastener 102 has a generally flat profile to reduce visual bulk and is generally lightweight to reduce sagging of the decoration 104 and pulling of the decorative material 10 due to gravity, as well as increase comfort during use. For example, the decoration 104 may weigh up to approximately 1.5 ounces and be up to approximately 0.5 inches thick. However, other weights and sizes are contemplated. The decoration 104 may be, for example, a brooch, decorative pin, or the like.

Figure 2:
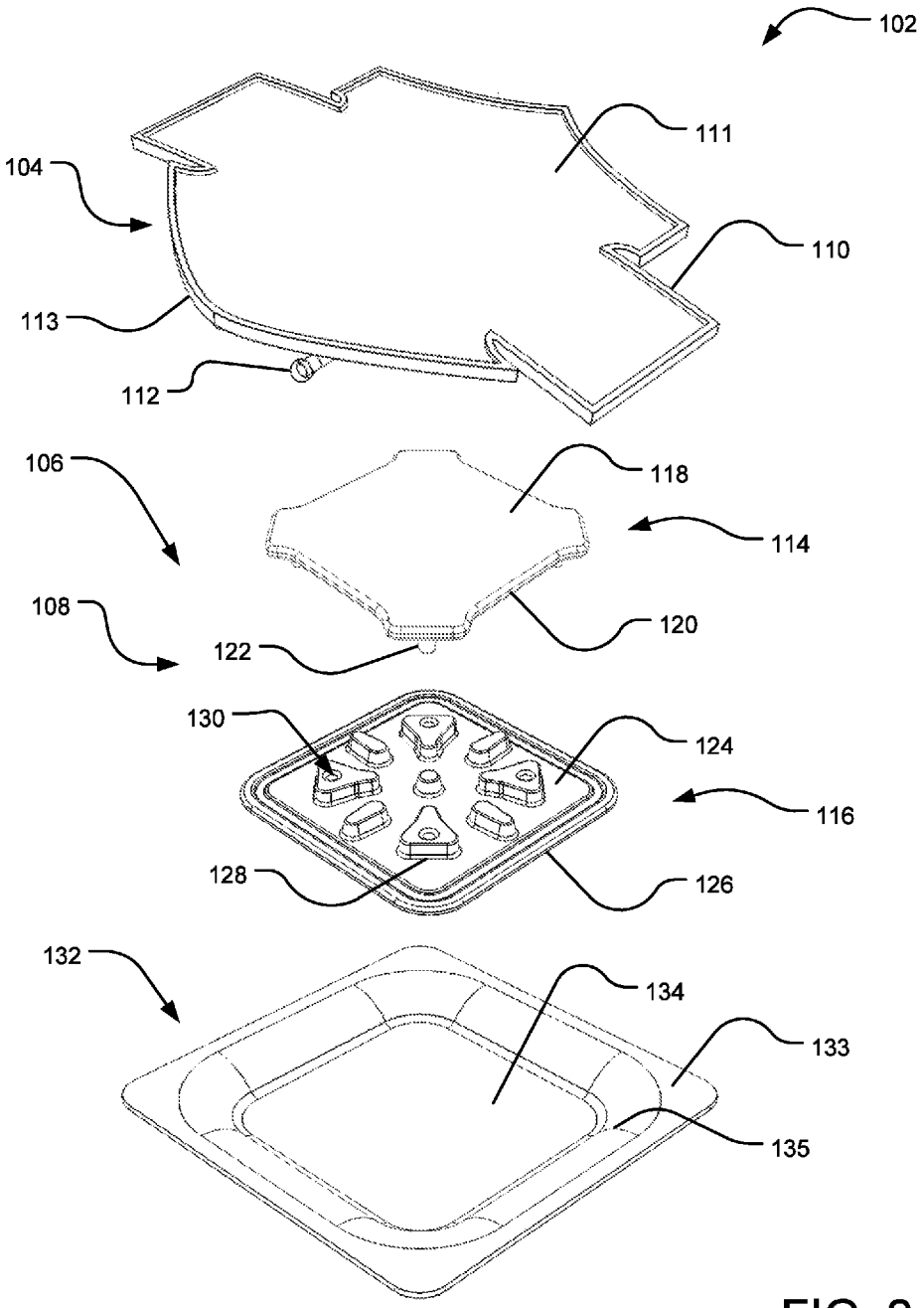
FIG. 2 is an exploded view of the decorative fastener.

Turning to FIG. 2, an exploded view of the decorative fastener 102 is shown. In one implementation, the decorative fastener 102 includes the decoration 104 and the fastener 106, which includes a receiver 108. The decoration 104 includes a decorative member 110 and a pin 112.

The decorative member 110 may be any shape and include one or more decorative surfaces 111 displaying aesthetic content. The decorative surfaces 111 may be smooth, angular, contoured, textured, and/or the like. The aesthetic content may include, without limitation, one or more colors, patterns, logos, jewelry, designs, pictures, and other aesthetic content. For example, the aesthetic content may include a sports logo or memorabilia, a company logo or trademark, marketing content, or other community or group identifying content. The pin 112 is mounted or otherwise extends from a fastening surface 113. The receiver 108 is configured to receive the pin 112 to fasten the decoration 104 to the decorative material 10.

In one implementation, the receiver 108 includes an enclosing plate 114 and a receiving plate 116. The enclosing plate 114 includes a first surface 118 positioned generally opposite a second surface 120, with one or more posts 122 extending from the second surface 120. The posts 122 are configured to engage corresponding features in the receiving plate 116 to secure the enclosing plate 114 to the receiving plate 116.

The second plate 116 includes a first surface 124 positioned generally opposite a second surface 126. In one implementation, the first surface 124 and the second surface 126 are substantially planar. The first surface 124 includes one or more receiving features 128 protruding from or otherwise defined in the first surface 124. Some or all of the receiving features 128 may include holes 130 defined therein. In one implementation, the holes 130 are configured to receive and engage the posts 122 of the engaging plate 114 to cover the receiving features 128 and/or at least a portion of the first surface 124. Generally, the receiving features 128 form a plurality of fastening paths configured to receive the pin 112 in different orientations. As such, the decoration 104 may be easily oriented in a variety of manners and positions independent of the orientation of the decorative material 10. Stated differently, an orientation of the decorative surface 111 is based on a selection of one of the fastening paths, and with the availability of a variety of fastening paths oriented in different manners and/or directions, the decorative surface 111 may be fastened to the decorative surface 50 of the decorative material 10 in an upright orientation by selecting the appropriate fastening path.

In one implementation, the receiver 108 is fixed to a pocket 132, which secures the receiver 108 to the decorative material 10. The pocket 132 may include a mounting surface 133 configured to engage the decorative material 10 and a mating surface 134 configured to engage the second surface 126 of the receiving plate 116. In one implementation, the pocket 132 includes a tapered surface 135 connecting the mounting surface 133 to the mating surface 134. The mounting surface 133 of the pocket 132 may be sewn onto or otherwise attached to the decorative material 10. In another implementation, the receiver 108 is directly fixed to the decorative material 10. The pocket 132 and/or the receiver 108 may be attached to the hidden surface 100 or an inner surface of the decorative material 10, such that the pocket 132 and receiver 108 are substantially hidden from view. Further, a plurality of receivers 108 may be attached to the decorative material 10 at different locations to provide various options for placing and orienting the decoration 104 on the decorative material 10. In other implementations, neither the pocket 132 nor the receiver 108 is affixed to the decorative material 10, and the decoration 104 is removably fastened to the decorative material 10 by penetrating or otherwise threading the decoration 104 through the decorative material 10 into the receiver 108. Alternatively, the decoration 104 does not penetrate the decorative material 10 and is removably mounted to the decorative material 10 using one or more magnets in the receiver 108, which may be fixed to the decorative material 10 or held up against the decorative material 10 to magnetically couple corresponding magnet(s) in the decoration 104.

Figure 3:
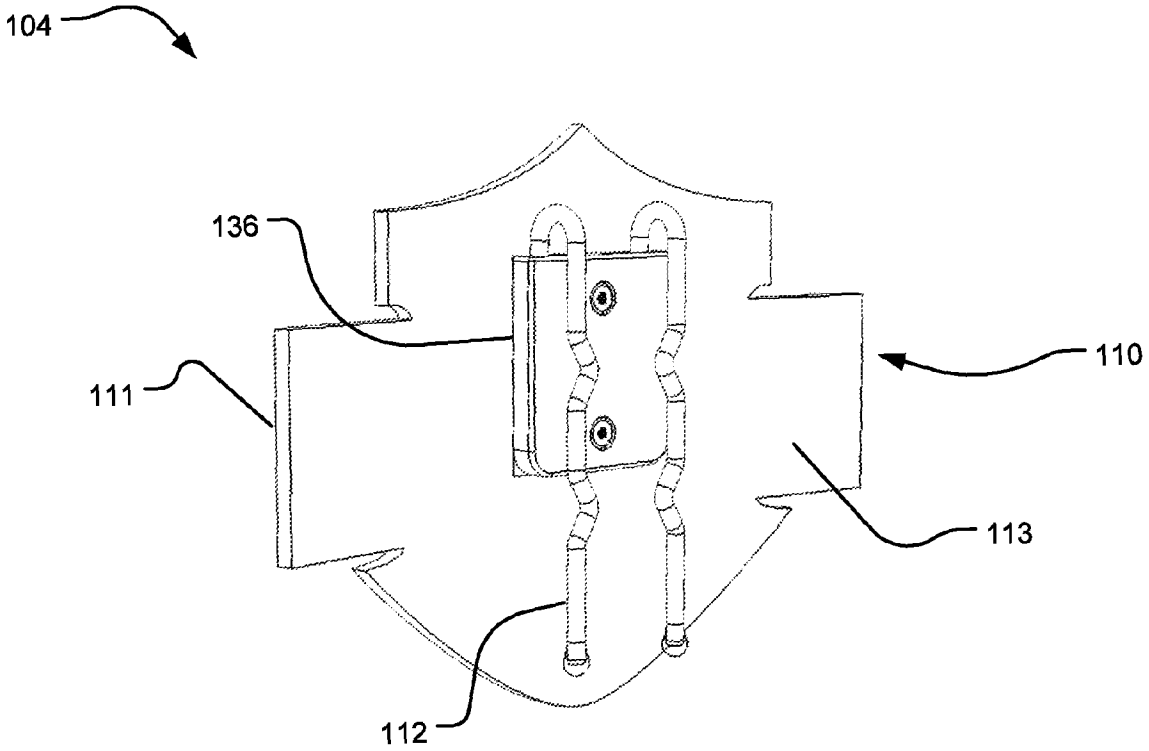
FIG. 3 is a back perspective view of the decoration.
Figure 4:
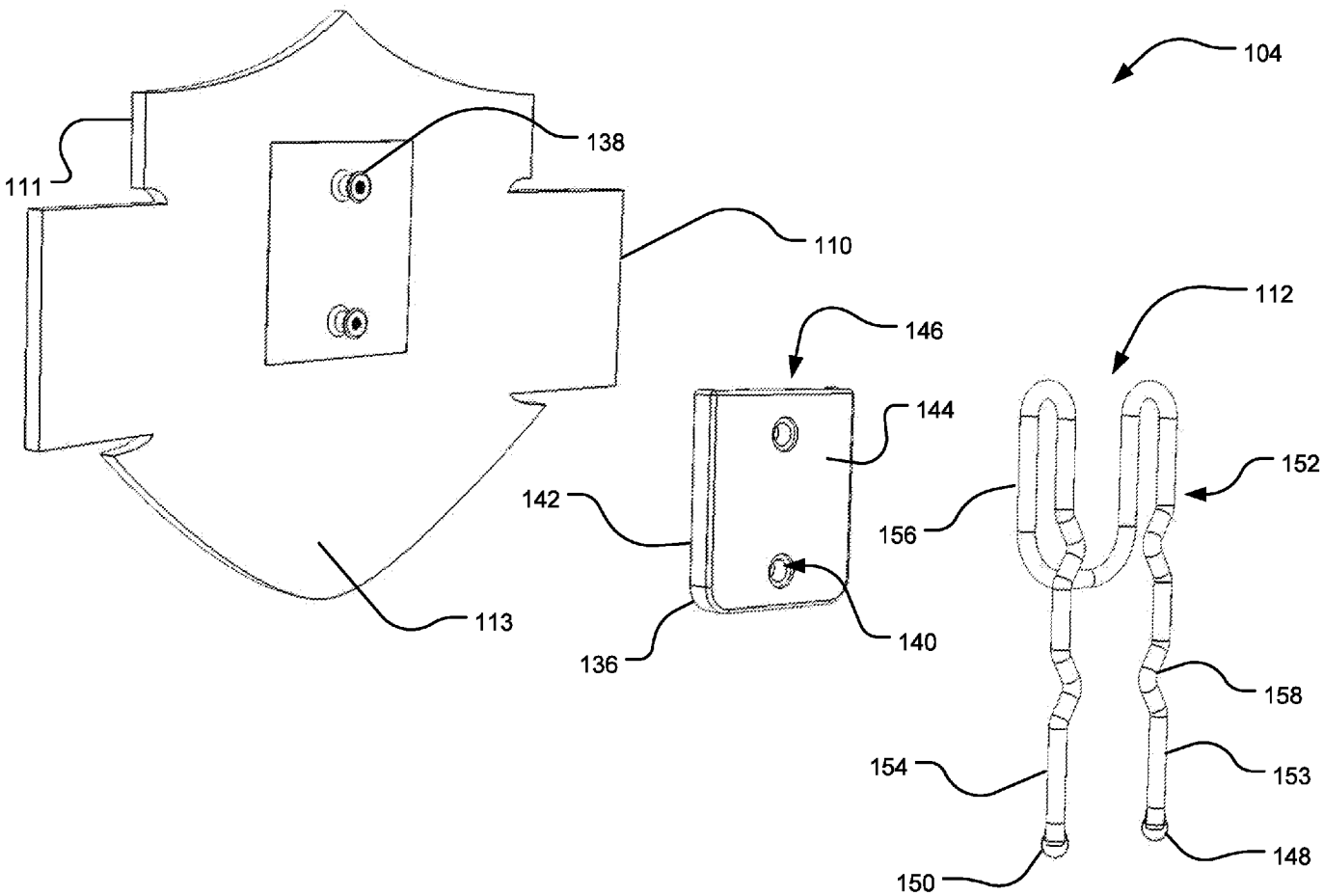
FIG. 4 is an exploded view of the decoration.

As can be understood from FIGS. 3-4, which are back perspective and exploded views of the decoration 104, respectively, in one implementation, the pin 112 is mounted on the fastening surface 113 of the decorative member 110 with a pin mount 136. The fastening surface 113 of the decorative member 110 may include one or more engaging features to engage the pin mount 136. In one implementation, the decorative member 110 includes one or more posts 138 extending from the fastening surface 113 through one or more holes 140 in the pin mount 136. The holes 140 extend from a first side 142 of the pin mount 136 to a second side 144. The posts 138 include a flat tip that fixes the pin mount 136 to the fastening surface 113 of the decorative member 110. Stated differently, the posts 138 are inserted through the holes 140, and the posts 138 are hit with a force to create a flat tip that engages a portion of the second side 144 to fix the pin mount 136 to the fastening surface 113. In another implementation, one or more screws (not shown) are inserted through the holes 140 to engage one or more respective holes in the fastening surface 113. Other mechanisms for engaging and/or mounting the pin mount 136 to the fastening surface 113 are contemplated.

When the pin mount 136 is fixed to the fastening surface 113, the first side 142 of the pin mount 136 faces in a direction towards the decorative member 110. In one implementation, the first side 142 of the pin mount 136 includes a channel 146 defined therein, adapted to engage at least a portion of the pin 112 to secure the pin 112 to the decorative member 110. In this implementation, once the pin 112 engages the channel 146, the pin 112 extends in a direction away from the fastening surface 113 of the decorative member 110 to engage the receiver 108. When the pin 112 engages the receiver 108, in one implementation, the first surface 118 of the engaging plate 114 faces a direction generally towards the decoration 104, such that at least a portion of the decorative material 10 extends between the first surface 118 of the engaging plate 114 and the second side 144 of the pin mount 136.

In one implementation, the pin 112 includes a first blunt end 148 and a second blunt end 150. The blunt ends 148, 150 are each adapted to penetrate or thread through an opening in the decorative material 10 without harming the decorative material 10 and/or the person wearing decorative material 10. In one implementation, the pin 112 includes an elongated body 152 extending between the first blunt end 148 and the second blunt end 150. The elongated body 152 includes a securing portion configured to engage the receiving features 128 of the receiver 108. In one implementation, the securing portion includes a first securing body 153 and a second securing body 152. The first securing body 153 extends from the first blunt end 148 to a mounting portion 156, and the second securing body 154 extends from the second blunt end 150 to the mounting portion 156. In one implementation, the first securing body 153 extends substantially parallel to the second securing body 154.

The securing portion of the elongated body 152 includes one or more securing features 158, which are configured to removably engage the receiver 108 to fasten the decorative member 110 into a selected orientation. In one implementation, the securing features 158 are shaped, sized, and otherwise configured to be matingly engage the receiving features 128 of the receiving plate 116. As shown in FIGS. 3 and 4, in one implementation, the securing features 158 are angled notches in the first securing body 153 and/or the second securing body 154.

Figure 5:
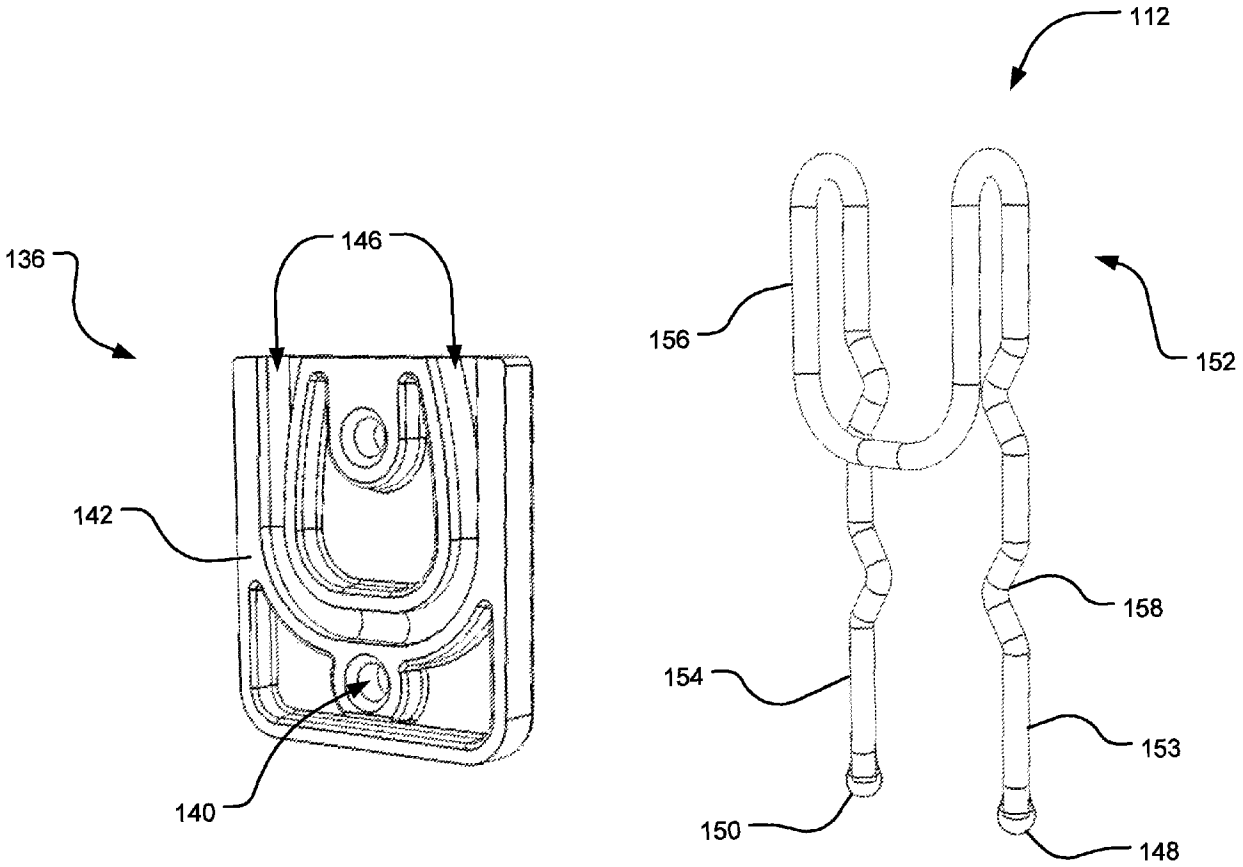
FIGS. 5 and 6 are front perspective views of a pin and pin mount, shown uncoupled and coupled, respectively.
Figure 6:
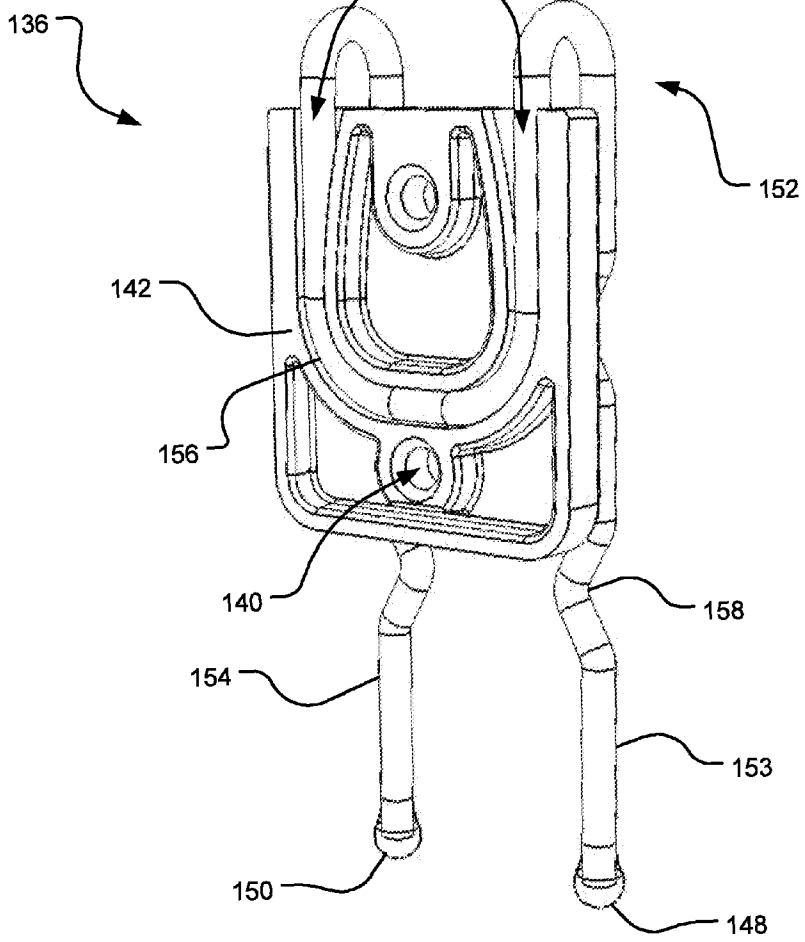
Figure 7A:
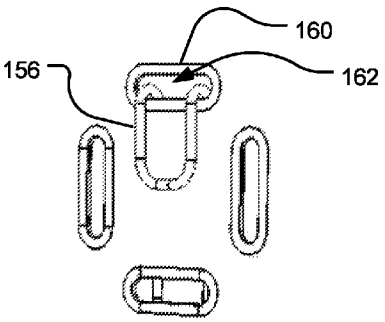
FIGS. 7A and 7B show front and back perspective views, respectively, of the pin inserted through an eyelet of the garment.
Figure 7B:
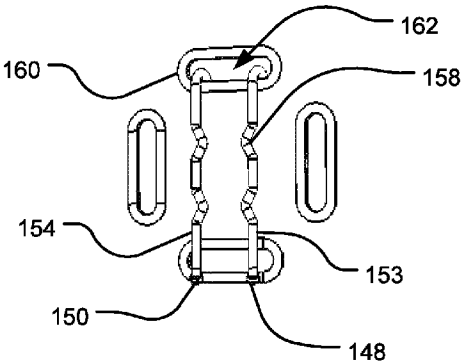
Figure 7C:
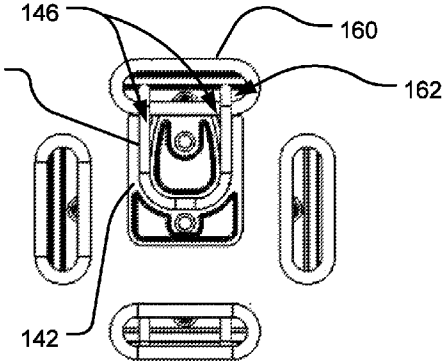
FIG. 7C illustrates a front perspective view of the pin coupled to the pin mount and inserted through an eyelet of the garment.
Figure 7D:
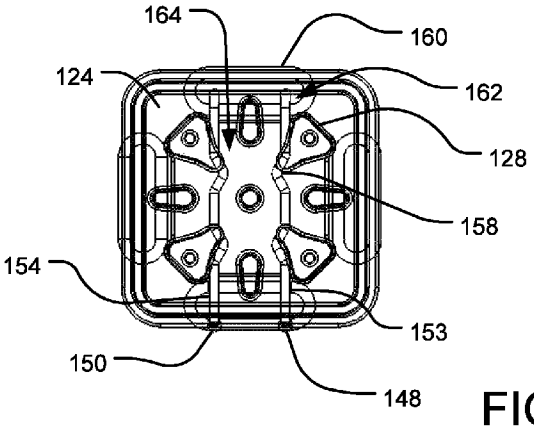
FIG. 7D is a back perspective view of the pin inserted through an eyelet of the garment and engaged to a second plate of a receiver. The receiver is shown as transparent for clarity.

Turning to FIGS. 5 and 6, which are front perspective views of the pin 112 and the pin mount 136 shown uncoupled and coupled, respectively, in one implementation, the mounting portion 156 of the elongated body 152 is configured to be received by and engage the channel 146 of the pin mount 136. The channel 146 is shaped to mirror and matingly engage the mounting portion 156 to secure the pin 112 to the pin mount 136. In one implementation, the mounting portion 156 and the channel 146 are each contoured. For example, the mounting portion 156 may form a general U-shape, with the curved portion of the U-shape extending towards the first and second blunt ends 148 and 150, and the channel 146 may be shaped to mirror the U-shape of the mounting portion 156.

As can be understood from FIGS. 7A-7D, the pin 112 is configured for threading through an opening 162 in or to otherwise penetrate through the decorative material 10 into the receiver 108. The opening 162 in the decorative material 10 may be formed from the space between each of the fibers of the textile material of the decorative material 10, through eyelets 160 sewn into or otherwise formed in the decorative material 10, or the like. The eyelets 160 may provide assistance in locating the decoration 104 on the decorative material 10 relative to the receiver 108. In some implementations, a plurality of openings 162 or eyelets 160 are positioned on the decorative material 10 such that a person may choose an available eyelet 160 that causes the decorative member 110 to be secured on the decorative surface 50 of the decorative material 10 in a desired orientation. For example, a scarf may be placed on a person in a variety of manners and it is often inconsistent where different portions of the scarf come to rest relative to the person and other areas of the scarf. As such, the plurality of eyelets 160 or other openings 162 permits the decorative member 110 to be easily fastened to the scarf in a desirable orientation (e.g., on a front and outwardly facing region of the scarf in an upright position) regardless of how the scarf is placed on the person. The openings 162 are positioned adjacent to fastening paths 164 formed by the receiving features 128 of the receiving plate 116, such that the securing portion (e.g., the first securing body 153 and the second securing body 154) may be inserted through one of the openings 162 and along the fastening path 164 adjacent to the selected opening 162 until the securing features 158 engage the receiving features 128.

Figure 8:
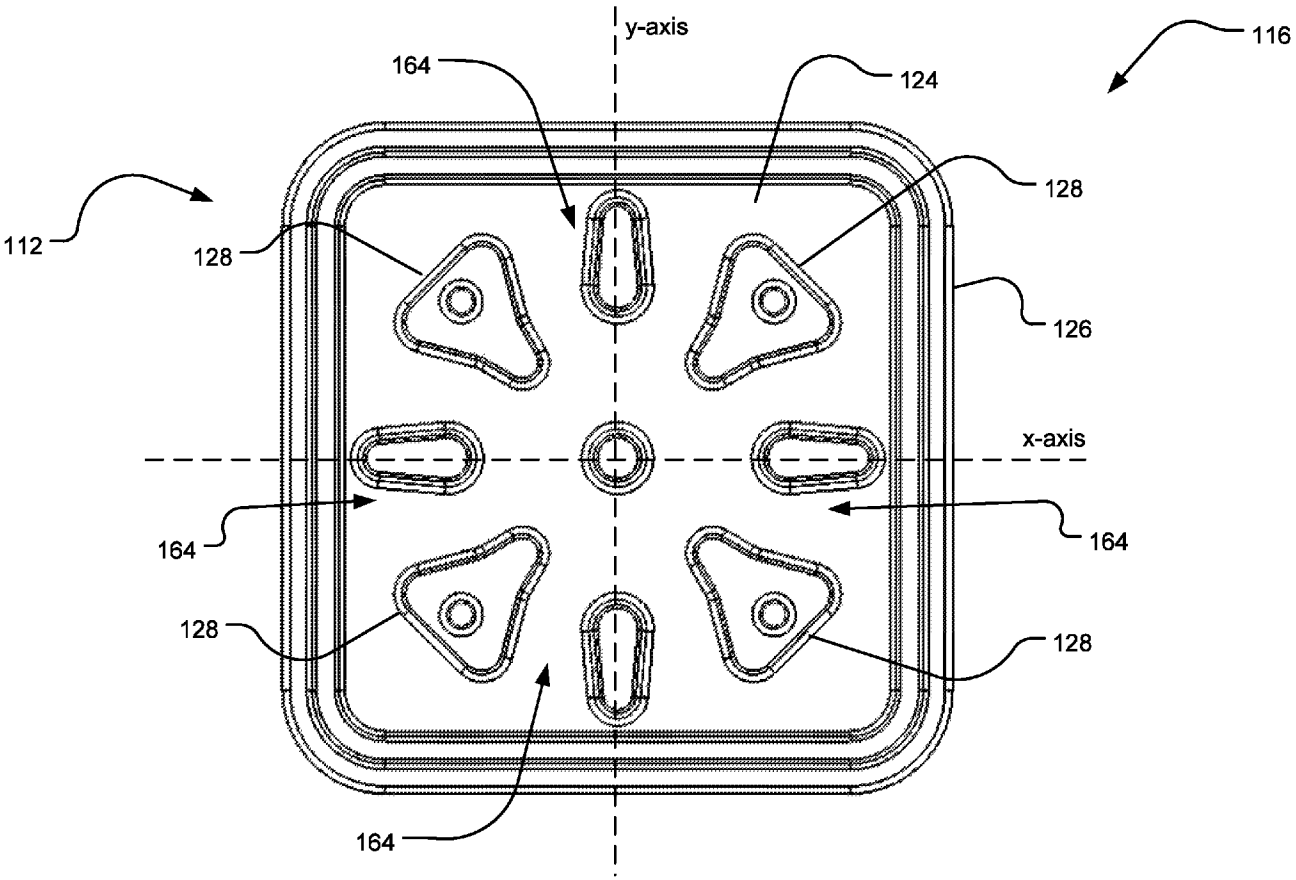
FIG. 8 shows a plurality of receiving features on the second plate of a receiver.

For a detailed discussion of the receiving plate 116, reference is made to FIG. 8. In one implementation, the receiving features 128 are generally triangular in shape. However, other shapes including, but not limited to, circular, elliptical, rectangular, conical, cylindrical, pyramidal, or the like are contemplated. In one implementation, the orientation and/or positioning of the receiving features 128 on the first surface 124 form different of fastening paths 164. Stated differently, the receiving features 128 are oriented relative to each other to create a plurality of available fastening paths 164 through which the first securing body 153 and/or the second securing body 154 of the pin 112 may be inserted to engage the receiving features 128. The receiving features 128 may be symmetrically oriented on the first surface 124, with the symmetrical orientation forming the fastening paths 164. For example, as shown in FIG. 8, each of the receiving features 128 may be symmetrical about an x-axis with first adjacent receiving feature and symmetrical about a y-axis with a second adjacent receiving feature.

Figure 9:
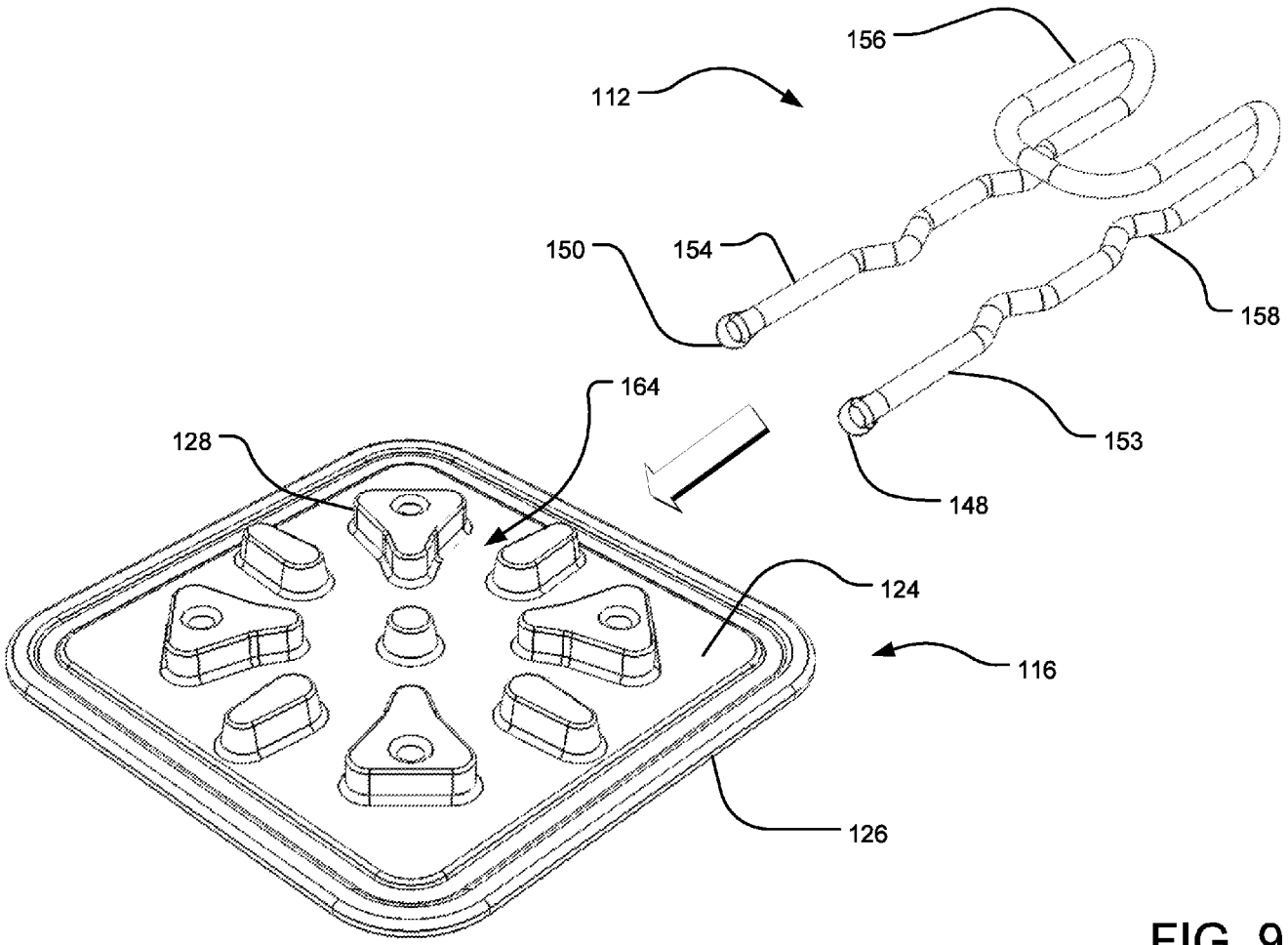
FIGS. 9 and 10 illustrate the pin and the second plate of the receiver uncoupled and coupled, respectively.
Figure 10:
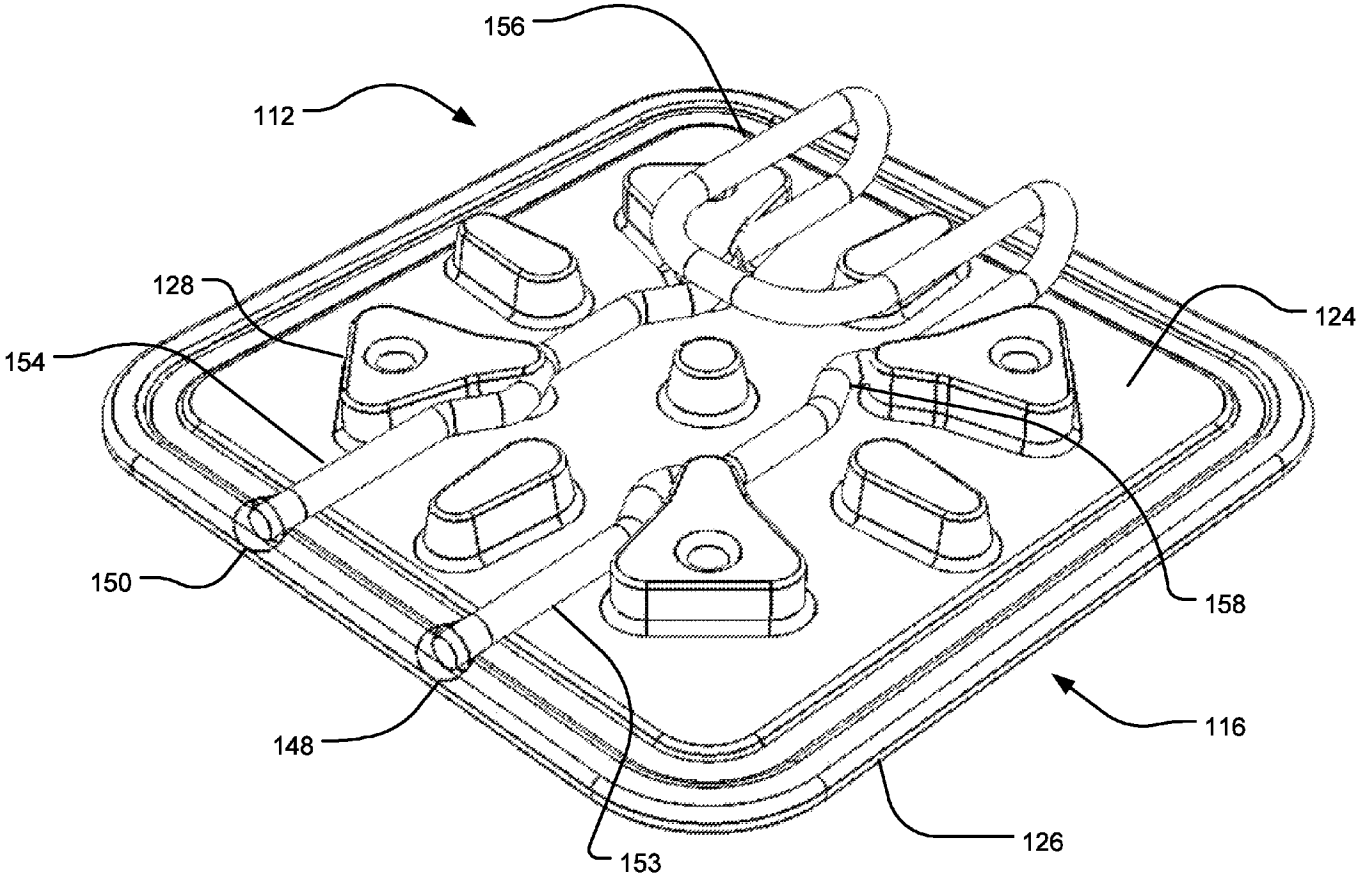

In one implementation, the receiving features 128 are positioned such that one corner of each of the receiving features 128 points towards one corner of an opposite receiving feature. As can be understood from FIGS. 9 and 10, which illustrate the pin 112 and the second plate 116 of the receiver 108 uncoupled and coupled, respectively, an indent in each of the receiving features 128, for example at the corners of the receiving features 128, may be configured to engage the securing features 158 of the pin 112. In one implementation, the pin 112 is configured to slide into one of the fastening paths 164 until the securing features 158 on the elongated body 152 engage one or more of the receiving features 128. Stated differently, the fastening paths 164 are each configured to slidably receive the securing portion of the pin 112 until the pin 112 is fastened to the receiving plate 116 using the securing features 158 and the receiving features 128. For example, the securing portion (e.g., the first securing body 153 and the second securing body 154) of the pin 112 may be inserted through the opening 162 in the decorative material 10 and engage an opening in the receiver 108 formed by a connection of the enclosing plate 114 with the receiving plate 116 adjacent to the opening 162. The securing portion of the pin 112 then changes angles relative the opening in the receiver 108 and slides through the opening 162 along the fastening path 164 until the securing features 158 on the securing portion of the pin 112 engage one or more of the receiving features 128. Other manners of engaging the pin 112 to the receiving features 128 of the receiver 108 are contemplated.

Figure 11:
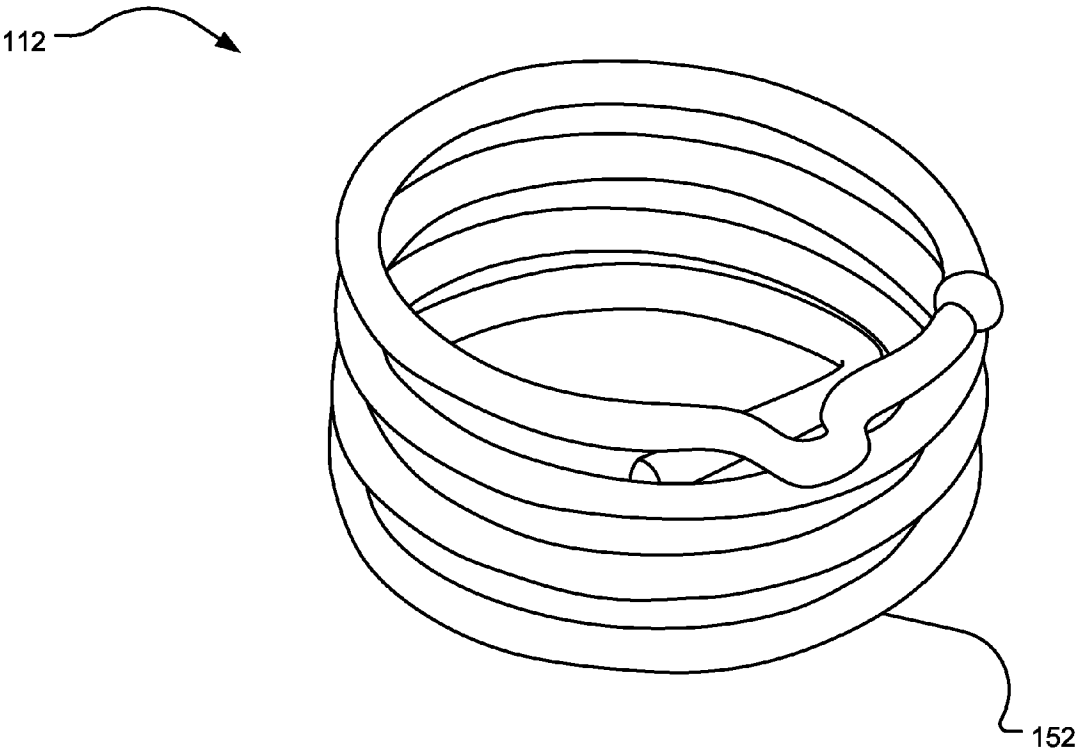
FIG. 11 shows the pin as a helical spring.

As can be understood from FIG. 11, the pin 112 may be a variety of shapes and mechanisms. For example, in some implementations, the elongated body 152 of the pin 112 forms a helical spring, such that the decoration 104 may be twisted or otherwise rotated into the decorative material 10 and secured into a desired position. Further, in some implementations, the pin 112, the pin mount 136, and/or the fastener 106 may be replaced by or otherwise include one or more magnets.

Figure 12:
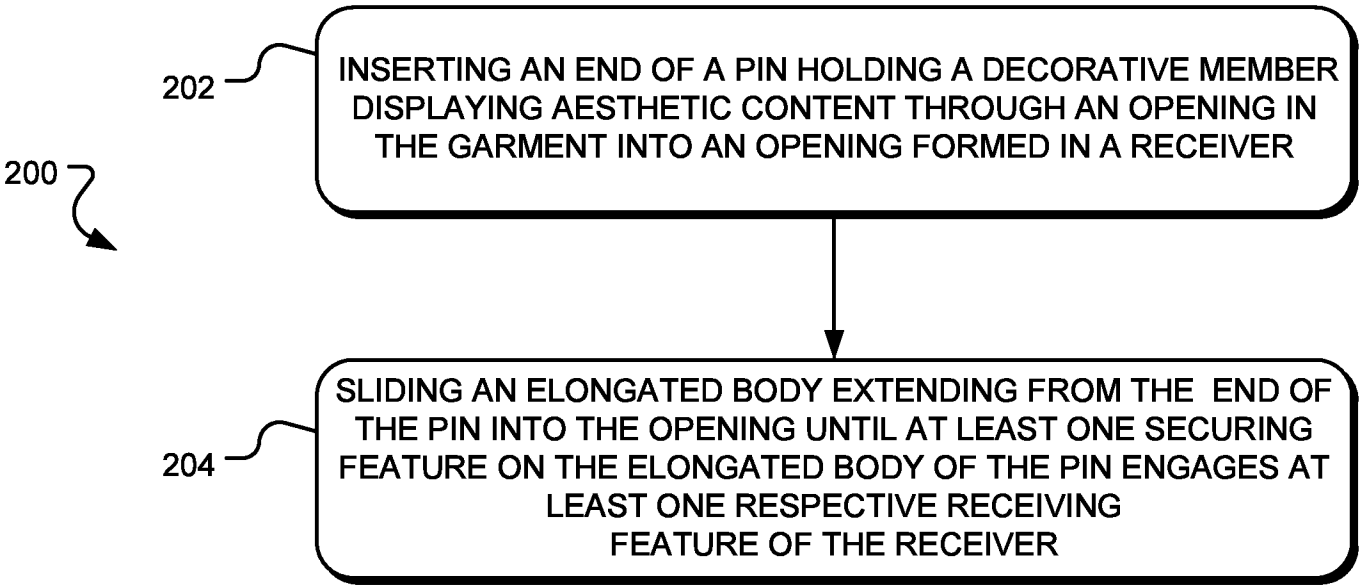
FIG. 12 illustrates example operations for securing a decorative fastener to a garment for display.

FIG. 12 illustrates example operations 200 for securing a decorative fastener to a garment for display. In one implementation, an inserting operation 202 inserts an end of a pin though an opening in the garment. The pin is an elongated body that is configured to hold a decorative member displaying aesthetic content on a decorative surface. The inserting operation 202 inserts the end into an opening formed in a receiver. In one implementation, the opening in the receiver is formed by a connection of an enclosing plate with a receiving plate adjacent to the opening in the garment. A sliding operation 204 slides the elongated body of the pin through the opening in the garment into the opening in the receiver along a fastening path until at least one securing feature of the pin engages at least one respective receiving features of the receiver, thereby fastening the decorative member to the garment in a desired orientation.

In the present disclosure, it is understood that the specific order or hierarchy of steps in the methods disclosed are instances of example approaches. Based upon design preferences, it is understood that the specific order or hierarchy of steps in the method can be rearranged while remaining within the disclosed subject matter. The accompanying method claims present elements of the various steps in a sample order, and are not necessarily meant to be limited to the specific order or hierarchy presented.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes. Stated differently, while the present disclosure has been described with reference to various implementations, it will be understood that these embodiments are illustrative and that the scope of the present disclosure is not limited to them. Many variations, modifications, additions, and improvements are possible. Functionality may be separated or combined differently in various implementations of the disclosure or described with different terminology. These and other variations, modifications, additions, and improvements may fall within the scope of the disclosure as defined in the claims that follow.

What is claimed is:

1. A decorative fastener comprising:

a decoration having a decorative member and a pin, the decorative member having one or more decorative surfaces displaying aesthetic content and a fastening surface, the pin having a securing portion extending from the fastening surface, the securing portion having one or more securing features; and a receiver having at least one receiving feature protruding from a surface and forming a plurality of selective fastening paths, each of the selective fastening paths configured to removably receive the securing portion of the pin, wherein an orientation of the one or more decorative surfaces is based on a selection of one of the plurality of selective fastening paths.

2. The decorative fastener of claim 1, wherein the plurality of selective fastening paths are each configured to slidably receive the securing portion of the pin until the one or more securing features engage the at least one receiving feature.

3. The decorative fastener of claim 1, wherein the at least one receiving feature is generally triangular in shape with an indent defined therein and the one or more securing features are angled notches configured to engage the indent in the at least one receiving feature.

4. The decorative fastener of claim 1, wherein the securing portion includes a first securing body extending from a mounting portion to a first blunt end and a second securing body extending from the mounting portion to a second blunt end, the mounting portion being mounted on the fastening surface of the decorative member.

5. The decorative fastener of claim 4, wherein the mounting portion of the pin is mounted on the fastening surface of the decorative member with a pin mount.

6. The decorative fastener of claim 4, wherein the first securing body extends substantially parallel to the second securing body.

7. A decorative fastener comprising:

a decorative member having one or more decorative surfaces displaying aesthetic content and a fastening surface;

a pin mount fixed to the fastening surface of the decorative member, the pin mount having a channel, the pin mount having at least one hole, the decorative member having at least one post extending from the fastening surface through the at least one hole, a flat tip of the at least one post fixing the pin mount to the decorative member; and a pin having an elongated body extending from a first blunt end to a second blunt end, the elongated body having a mounting portion extending through and engaging the channel of the pin mount and a securing portion having one or more securing features.

8. The decorative fastener of claim 7, wherein the channel and the mounting portion of the elongated body of the pin are contoured.

9. The decorative fastener of claim 7, wherein the one or more securing features are angled notches.

10. The decorative fastener of claim 7, wherein the decorative member weighs up to approximately 1.5 ounces.

11. The decorative fastener of claim 7, wherein the securing portion includes a first securing body extending from the first blunt end to the mounting portion and a second securing body extending from the second blunt end to the mounting portion.

12. The decorative fastener of claim 11, wherein the first securing body extends substantially parallel to the second securing body.

13. A system for displaying aesthetic content, the system comprising:

a decorative material having a plurality of openings extending through a decorative surface and a hidden surface; and a receiver fixed to the hidden surface of the decorative material, the receiver including a receiving plate having a plurality of receiving features protruding from a first surface on the receiving plate towards the hidden surface of the decorative material, the plurality of receiving features symmetrically oriented on the first surface, the symmetrical orientation forming a plurality of fastening paths, each of the plurality of fastening paths positioned adjacent to at least one of the plurality of openings.

14. The system of claim 13, wherein the receiver is fixed to the hidden surface with a pocket.

15. The system of claim 13, wherein the decorative material is at least one of: a scarf, a shawl, a hat, a jersey, a coat, a sweater, a shirt, pants, or a bag.

16. The system of claim 13, wherein each of the plurality of receiving features is generally triangular in shape with one corner of each of the plurality of receiving features pointing towards at least one corner of an opposite receiving feature.

17. The system of claim 13, wherein the symmetrical orientation comprises each of the plurality of receiving features being symmetrical about an x-axis with a first adjacent receiving feature and about a y-axis with a second adjacent receiving feature.

18. The system of claim 13, wherein the first surface is substantially planar.

19. The system of claim 13, wherein the receiver further includes an enclosing plate configured to engage the receiving plate to cover the plurality of receiving features.

* * * * *